United States Patent [19]

Hirabayashi et al.

[11] Patent Number: 4,525,058

[45] Date of Patent: Jun. 25, 1985

[54] IMAGE FIXING DEVICE

[75] Inventors: Hiromitsu Hirabayashi; Masaaki Sakurai, both of Yokohama; Kazuo Kagiura, Tokyo, all of Japan

[73] Assignee: Canon Kabushiki Kaisha, Tokyo, Japan

[21] Appl. No.: 540,616

[22] Filed: Oct. 11, 1983

[30] Foreign Application Priority Data

Oct. 15, 1982 [JP] Japan ..... 57-181814
Feb. 28, 1983 [JP] Japan ..... 58-33039

[51] Int. Cl.[3] ..... G03G 15/00

[52] U.S. Cl. ..... 355/3 FU; 355/14 FU; 355/3 SH

[58] Field of Search ..... 355/3 SH, 3 FU, 14 FU; 361/212, 214

[56] References Cited

U.S. PATENT DOCUMENTS

| | | | |
|---|---|---|---|
| 368,315 | 8/1887 | Bathrick | 361/214 |
| 1,900,543 | 3/1933 | Cochrane | 361/214 |
| 1,941,666 | 1/1934 | Dickie et al. | 361/212 |
| 4,307,432 | 12/1981 | Nishikawa | 361/214 |

*Primary Examiner*—A. T. Grimley
*Assistant Examiner*—David S. Warren
*Attorney, Agent, or Firm*—Fitzpatrick, Cella, Harper & Scinto

[57] ABSTRACT

An image fixing device, including first and second rotatable members for forming a nip therebetween, which transports from an entrance side to an exit side a recording material and fixes an image thereon; a mechanism for driving the first and second rollers; charge removing members having charge removing ends arranged along a longitudinal direction of the rotatable members and adjacent to a peripheral surface of the first rotatable member without contact thereto, the charge removing ends are within a region defined by the exist side ends of press-contact areas between the first rotatable member and the recording material and between the second rotatable member and the recording material, peripheral surfaces of the first and second rotatable members at the exit side, and a common tangent plane which is tangent to both of the peripheral surfaces of the first and second rotatable members at the exist side.

34 Claims, 9 Drawing Figures

IMAGE FIXING DEVICE

BACKGROUND OF THE INVENTION

1. Field of the Invention

The present invention relates to an image fixing device usable with a recording apparatus such as electrophotographic apparatus, electrostatic recording apparatus and the like, more particularly to an image fixing device wherein the possible offset of the material to be fixed is reduced or prevented effectively, the offset occurring to a rotatable member which is used for heating, pressing or heating and pressing, the material to be fixed in order to fix an unfixed image on a recording material.

2. Description of the Prior Art

In order to fix an image on a plain paper, an image forming apparatus widely uses a combination of a fixing roller and a pressing roller forming a nip therebetween.

This type of fixing device involves a problem that triboelectric charge is produced by the contacts between the plain paper and the rollers and between the rollers with the result of the plain paper winding or twining about the surfaces of rollers.

To solve this problem, Japanese Utility Model Application Publication No. 41793/1982 and Japanese patent application laid open under No. 143474/1981 propose that a charge removing brush is simply contacted to a roller surface, and that an alternating current is applied to the roller via a charge removing brush, respectively.

When those are put into practice, however, the ends of the charge removing brushes are stained by toner particles and paper dust with use so that the function of the charge removal is rapidly degrated. In other words, the function is so easily influenced by the period of use that the durability is not satisfactory.

It is true that the charge removal of those conventional devices is effective, to some extent, to prevent the twining or winding, of the recording material, about the rollers. However, the toner offset to the roller can not be satisfactorily prevented, because the charge removal function quickly decreases, which leads to the occurrence of offset toner which cannot be removed therefrom by a roller cleaner (blade or felt).

Since the triboelectric charge increases with the amount and speed of plain paper or recording material passing through the nip, the method or device lacking the durability is not practical.

SUMMARY OF THE INVENTION

It is the principal object of the present invention to solve the above described problems with the prior art.

It is an object of the present invention to provide an image fixing device wherein the charge removing function can be maintained for a long period, and wherein the offset can be substantially prevented.

It is another object of the present invention to provide an image fixing device having charge removing means of non-contact type with high performance.

It is a further object of the present invention to provide an image fixing device having compact charge removing means which can be located adjacent to the nip between the rollers without contact therewith.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

To accomplish one or more of the above described objects, the image fixing device of the present invention includes charge removing members having charge removing ends which are located adjacent a position where the rotatable members are being spaced apart from the recording material after the contact therebetween, without contact with the rollers. The performance of the charge removal is highly improved. And, a remarkable charge removing effect is provided together with the improvement in the fixativeness.

Figure 1:
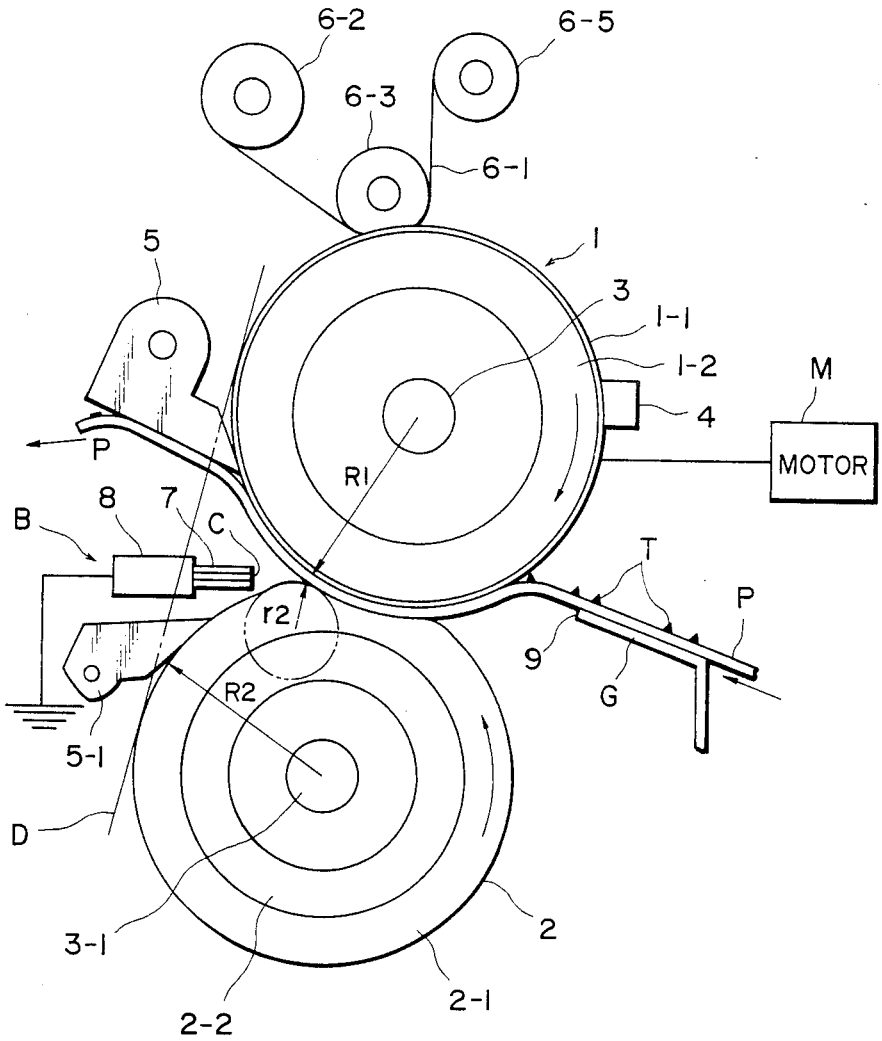
FIG. 1 is a side view of an image fixing device according to an embodiment of the present invention.

Referring now to FIG. 1, the image fixing device according to an embodiment of the present invention receives plain paper P bearing a toner image T and fixes the image on the plain paper.

The fixing device comprises a heating roller 1 having therewithin a heater 3, such as a halogen heater. The heating roller 1 is rotated in the direction shown by the arrow by a driving motor M. Press-contacted to the heating roller 1 is a pressing roller 2 provided therewithin with a heater 3-1 having a smaller heating capability and driven through the press-contact with the heating roller 1.

The heating roller 1 includes a hollow roller 1-2 of a metal, such as aluminium, stainless steel and copper, and a heat-resistive parting resin layer 1-1 of 20–100$\mu$ thickness, such as tera-fluoroethylene resin or the like, on the outer surface of the hollow roller 1-2. The pressing roller 2, rotatably supported by unshown bearings, includes a metal roller 2-2 and a relatively thick layer 2-1 of insulating and resilient material, such as silicone rubber, fluorinated rubber fluoro-silicone rubber or the like, on the outer surface of the metal roller 2-2. The pressing roller is press-contacted to the heating roller, at least when the fixing operation takes place. Those structures are intended to assure the existence of the press-contact area between the heating and pressing rollers. The external surface of the heating roller 1 is contacted by a heat sensor 4, such as a thermistor, a thermocouple and the like, which transmits the detected temperature to a well-known control means, not shown, to maintain the surface temperature of the heating roller 1 at the toner fusing temperature by, for example, controlling the output of the heater 3 or the voltage applied thereto. The fixing device further includes separation pawls 5 and 5-1 for assuring the separation of the copy paper from the respective rollers.

The fixing device is further provided with cleaning means 6 for removing foreign matters, such as offset toner, paper dust and the like, attached to the surface of the heating roller 1. The cleaning member 6 includes a cleaning web 6-1 of a thermoresistive nonwoven fabric such as NOMEX (trademark, DUPONT) or the like.

The cleaning web 6-1 is press-contacted to the heating roller 1 by a resilient urging roller 6-3 of silicone rubber, fluoro-silicone rubber silicone rubber sponge. The web 6-1 is stretched between and wound around a supply roller 6-2 and a take-up roller 6-5 which is effective to slowly feed the web 6-1 so as to contact a fresh surface of the web 6-1 to the heating roller 1 at all times.

A guide member G is provided in order to introduce the plain paper P to the nip formed between the heating roller 1 and the pressing roller 2. The edge 9 of the guide member G is nearer to the heating roller 1. The plain paper P is, therefore, guided along the surface of the heating roller 1 to the nip.

A charge removing means B of non-contact type, provided at the paper exit side of the rollers 1 and 2, includes a grounded supporting member 8 and conductive needle-like members 7. The needle-like members (hereinafter also called "needles") are arranged over the entire length of the rollers 1 and 2. An end C of each of the needles is located adjacent to the exit side end of the nip, which is the area of press-contact between the heating roller 1 and the pressing roller 2. More particularly, the needle end C is located in the space between the exit side surfaces of the rollers 1 and 2 and a plane D tangent to both of the surfaces of the rollers 1 and 2 at the paper exit side. In addition, the charge removing means B is disposed between the separating pawls 5 and 5-1 described above.

The plain paper on which a toner image has been formed is guided to the heating roller 1 by the guiding member G. The toner image is heated, fused and fixed by the nip. The paper P, after passing through the nip, is wound around the heating roller 1 due to the adhesiveness of the toner, but separated by the separating pawl 5 from the heating roller 1 at the position where the separating pawl 5 is contacted thereto. The separated paper P is then guided by the bottom surface of the separating pawl, whereafter it is transported to unshown transporting rollers or discharging rollers. It is usual that, when the paper P goes out through the nip, the plain paper P is wound around the roller which gives the image fixing function, because the winding is caused by the adhesiveness of the toner. This applies to any roller performing the image fixing function by contacting the image. This is so, irrespective of whether it is of the heat fixing type or whether it is of the pressure fixing type. The tendency of winding or twining around the roller is stronger in a heat fixing type and remarkably strong when the paper P is pressed at its back side by a pressing roller whose surface has a higher resiliency than that of the heating roller 1.

In this embodiment of the present invention, the surface temperature of the heating roller 1 heated by the heater 3 (200 W) is set to be higher than that of the pressing roller 2 heated by the heater 3-1 (90 W) to improve the fixing capability. In this type of heating, the paper P forms such a curl that it goes along the surface of the heating roller 1, and then reaches the separating pawl 5. Since the pressing roller 2 having a diameter R2 press-contacted to the heating roller 1 having a diameter R1 ($R2 \simeq R1$), is of resilient nature, the curvature of the pressing roller 2 outer surface is higher at the exit side of the nip, that is, $r2 < R1$, R2, as shown in FIG. 1. This increases the tendency of the paper P curling toward the heating roller 1. This tendency is added to the tendency of the curling in the same direction given by the adhesiveness of the toner.

Thus, in this embodiment, the paper P is sure to be moved along the heating roller 1 surface after passing through the nip, because of various factors described above. The separating pawl 5-1 is provided to be safe in this embodiment. However, it is not absolutely necessary for this reason. Without the separating pawl 5-1, the charge removing means B can be nearer to the nip, which is desirable as will be described hereinafter.

When plain paper passes through a nip, the paper, heating roller and pressing roller, generally speaking, are electrically charged by triboelectricity and separation charging. This is a strong cause of the offset of the electrically charged toner and the cause of the paper twining about the roller. The device of the present invention, however, uses the charge removing means B as mentioned above, so that those causes can be removed to maintain a proper balance of surface potentials among those three members. In other words, the offset of the toner can be remarkably reduced, and in addition thereto, the charge removing effect which is better than in the prior art can be maintained for a long period of time.

Figure 2:
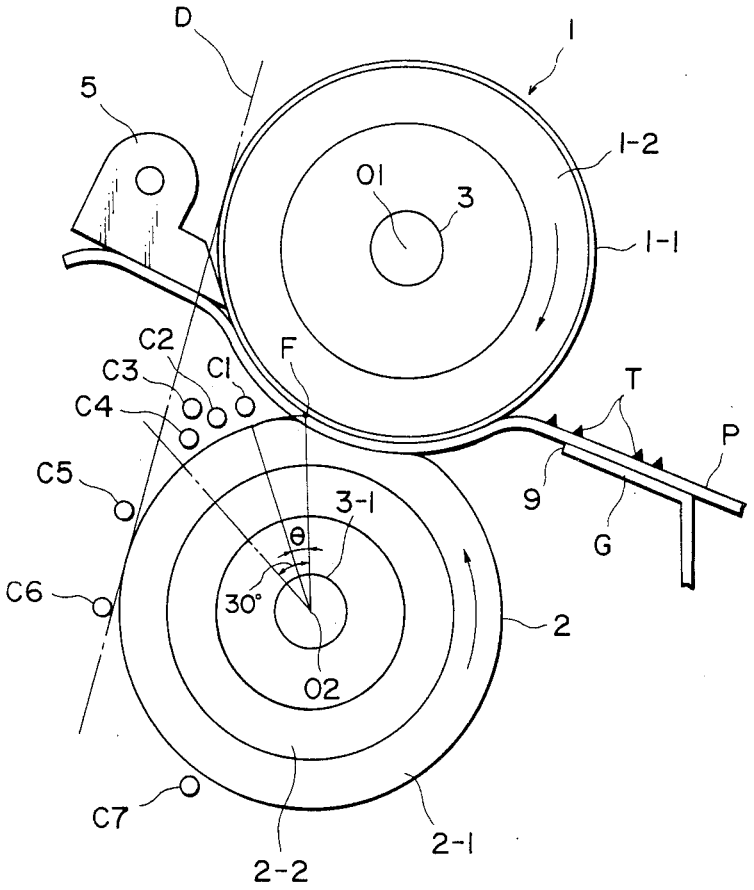
FIG. 2 is the same side view on which possible locations of the charge removing means are indicated.

The effects of the present invention will be described more in detail. FIG. 2 shows the positions of the charge removing end C of a needle-like charge removing member 7 in the device of FIG. 3. The positions are shown by reference characters C1–C7. The effects of the charge removing member 7 located at such various positions are shown in Table 1 below.

TABLE 1

| Positions of Charge Removing Ends C, Distance d (mm) and Angle $\theta$ (degree) | | | | Offset Toner (%) | Surface Potential of Pressing Roller (V) |
|---|---|---|---|---|---|
| Present Invention | C1 | 1.5 | 12 | 0.10 | −550 |
| Present Invention | C2 | 1.5 | 20 | 0.12 | −750 |
| Present Invention | C3 | 6 | 25 | 0.16 | −1500 |
| Present Invention | C4 | 1.5 | 30 | 0.14 | −1400 |
| | C5 | 4 | 55 | 0.35 | −2700 |
| | C6 | 1.5 | 82 | 0.42 | −2800 |
| | C7 | 1.5 | 138 | 0.45 | −2800 |
| No charge removing means | | | | 0.60 | −6000 or more |

In this table, $\theta$ is the angular distance of the position of the needle end C, measured in the direction of the pressing roller 2 rotation, from a reference line connecting the center of the pressing roller 2 and the exit side end F of the nip formed when there is paper in the nip, as shown in FIG. 2; and d is a distance of the position from the surface of the pressing roller 2.

The position C1 is substantially on an extension of the nip and in proximity with the pressing roller 2 and also in proximity with the heating roller 1 through the area where the paper passes. The position C2 is near the position C1 but slightly further spaced apart from the heating roller 1 surface and spaced apart from the pressing roller 2 by the same distance as with the position C1. The position C3 is a little further from the heating roller 1 and the pressing roller 2 than the position 2. The position C4 is distant from the pressing roller 2 surface by the same amount as with the positions C1 and C2.

The position C5 is downstream of the contact point between the above described separating pawl 5-1 (not shown in FIG. 2) and the pressing roller 2 with respect to the direction of the pressing roller rotation. The position C6 is further downstream thereof. The position C7 is more downstream than the position C6, and substantially diametrically opposite to the nip with respect to the heater 3-1.

The values given in Table 1 have been obtained when the fixing device of FIG. 1 with the rollers 1 and 2 having diameters 60 mm ($2\times R1=2\times R2=60$ mm), and the total pressure of 60 kg between the rollers. The paper P, which was JIS A4 size sheet, was fed at the speed of 23 sheets/min. (roller peripheral speed is 270 mm/sec). The toner used was negatively charged. The value of the offset toner is represented as the weight ratio (%) to the weight of the unfixed toner. The surface potential of the pressing roller 2 is given for reference since it has a direct influence to the negative toner.

Turning back to FIGS. 1 and 3, designated by reference character D is a common tangent line (plane) which is tangent both to the heating roller 1 surface and the pressing roller 2 surface at the paper exit side. The positions C1–C4 are within the space defined by the common tangent line (plane) and the surfaces of the heating and pressing rollers 1 and 2.

As indicated in Table 1, without charge removing means B having conductive needles, the amount of the offset toner was as large as 0.60%, and the surface potential of the pressing roller 2 was as high as 6000 V (negative polarity). It is a matter of source that there are many problems with such conditions.

When the charge removing means B was used under the condition that its charge removing ends were located at positions C1, C2, C3 and C4 according to the present invention, the amount of the offset toner and the surface potential of the pressing roller 2 were reduced to be one fourth ($\frac{1}{4}$) of those without the charge removing means B. No twining of the plain paper P took place.

When the charge removing ends were located at a position C5, C6 or C7 which was further from the nip, the amount of the offset toner was slightly reduced, and the surface potential of the pressing roller 2 was reduced, too, but the offset toner amount was still large, i.e., 0.3% or larger, and the pressing roller 1 surface potential was larger than 2000 V (negative). This potential is great enough to temporarily increase the offset toner so that it has often been observed that the toner image T on the plain paper P has been disturbed. It is not reliable for those reasons. In this case, the offset toner could not be completely removed by such a simple cleaning means as used ordinarily, so that the offset toner on the heating roller was often offset back to plain paper resulting in the stain of the image.

As will be understood from Table 1, the offset toner when the charge removing ends are located at the position C1, C2, C3 or C4, is $1/5$–$\frac{1}{4}$ of the offset toner when the charge removing ends are located at the position C5, C6 or C7. Also, the pressing roller surface potential can also be reduced to one half ($\frac{1}{2}$). It is thought that all the charging of the rollers 1 and 2 and all the friction with the plain paper take place at the nip formed between the rollers 1 and 2, and the resultant charge is relatively unstable and non-uniform over the length of the roller until the charge establishes the surface potential on the roller surface. The positions C1, C2, C3 and C4 are effective to remove the charge, while the triboelectric charge and separation charge are still unstable and non-uniform, that is, before the surface potential is firmly established. It is believed that it is for this reason that the charges can be removed efficiently. On the other hand, at the positions C5 and C7, the charge removing ends act on the surface where the surface potential has already become stable, so that the charge removing is less efficient to allow the surface potential to increase in the negative direction.

Thus, the reason for the shown effectiveness of the positions C1, C2, C3 and C4 is understood. Also, the same reason can explain the higher effectiveness of the positions C1 and C4 than the other, among positions C1, C2, C3 and C4.

The potential of the plain paper P could be reduced to not more than +200 V by placing the ends C at position C1, C2, C3 or C4, the potential being more than +1000 V when they are placed at positions C5, C6 and C7. Additionally, the shock possibly given to the operator by the charge could be reduced, and handling of the copy paper after the image formation was easier. Therefore, the charge removing member conventionally used at the copy paper exit could be made unnecessary. The surface potential of the heating roller 1 was found to be −100 V to −150 V in any cases.

Another embodiment of the present invention will be described in conjunction with FIGS. 3–7. The features of this embodiment are in that the ends C of the conductive needs are located adjacent to the nip at the paper exit side, and also in that the conductive needles are made integral with the separation pawl. In another aspect of this embodiment, the charge removing needles can be placed at any desired position because of the integrality thereof with the separation pawl.

Figure 3:
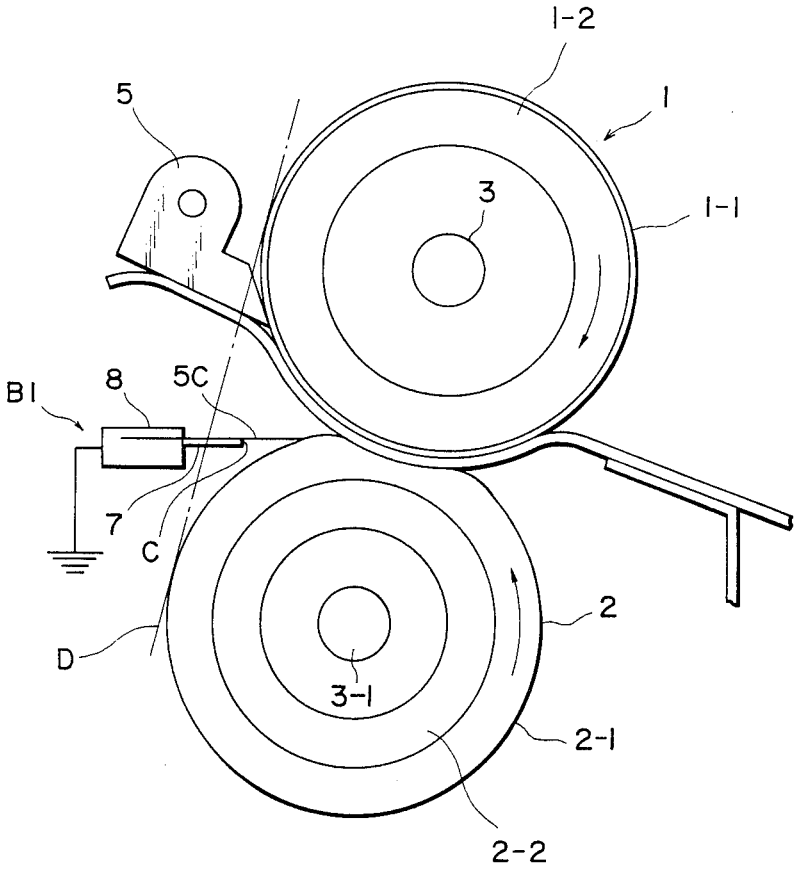
FIG. 3 is a side view of an image fixing device according to another embodiment of the present invention.

FIG. 3 shows a modification of FIG. 1 embodiment. A charge removing means B1 includes conductive needle-like members 7 and an integral separation pawl 5C on the upper surface of the needles 7. The separation pawl 5C may be of conductive material, but this embodiment employs an insulating material as this pawl in order to concentrate the electric field on the ends C of the conductive needles 7, thus increasing the charge removing effect. The material for this may be polyimide resin sheet, polyamide resin sheet, polyamide-imide resin sheet or Tefron (trademark) or the like. These are preferably made as a sheet, or a coating on a metal sheet. The above named materials have a heat-resistive property so that they are particularly suitable for a heat fixing device.

The integral separation and charge removing device of this embodiment is advantageous for the following reasons. Conventionally, the separation pawl for the pressing roller has been utilized in order to prevent the paper P from winding around it. The separation pawl gives a limitation to the position where the charge removing means is to be located. More specifically, the separation pawl has to have substantial mechanical strength so that it occupies a relatively large space around the roller surface. For this reason, the charge removing members have to be spaced by a relatively large distance. This makes it difficult to place the charge removing member at a position where it can efficiently function. That is, the charge removing members have been located relatively far away from the nip, resulting in a less efficient charge removal function. If a sheet-like separation pawl is used, and the conductive needles are located just therebehind, the supporting of the needles is so difficult that such arrangement cannot be put into practice.

Those problems have been overcome by this embodiment of the present invention. By making the sheet-like separation pawl and the conductive needles integral, the separation pawl can be easily supported, and also, the distance between the separating end and the conductive needles 7 can be remarkably reduced, so that the end of the separation pawl and the ends of the conductive needles can approach the nip. This provides both a stable paper separation and efficient charge removal from the pressing roller 2.

Figure 4:
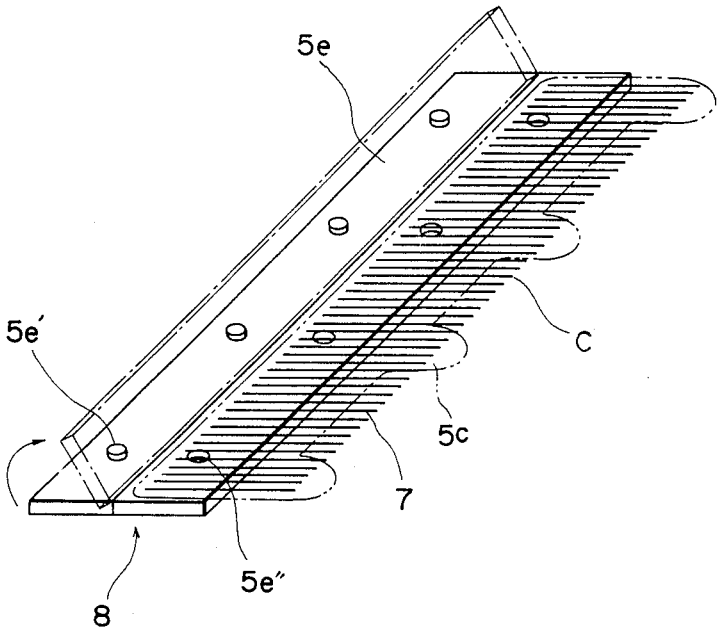
FIG. 4 is a perspective view of charge removing means according to an embodiment of the present invention.
Figure 5:
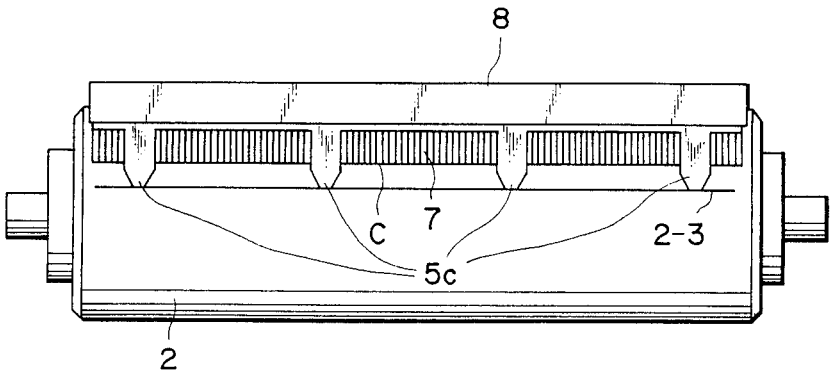
FIG. 5 is a top plan view of the pressing roller used with the embodiment of FIG. 3.

In this embodiment, the conductive needle-like members or needles 7 are supporting by a supporting member 8 made of a sheet of a metal, such as aluminum, copper or the like. The conductive needles 7 and the separation pawls 5C are gripped as shown in FIG. 4, wherein a foldable metal plate 5*e* has projections 5*e'* at several longitudinal positions, and the associated plate has recesses at such positions as to correspond to the projections. The separation pawl 5C has holes at such positions as to correspond to the projections and recesses. The separation pawl 5C and the conductive needles 7 can be fixed together by fitting the projections into the recesses through the holes of the separation pawl. The surface of the metal plate 5*e* of the supporting member 8 is coated with an electrically insulating material to make the electric field concentrate on the ends C of the conductive needles so as to enhance the charge removal efficiency. FIG. 5 is a top plan view of the pressing roller 2 and the integral separation pawl and charge removing needles, wherein the contact line between the end of separation pawl 5C and the pressing roller 2 is shown.

Figure 6:
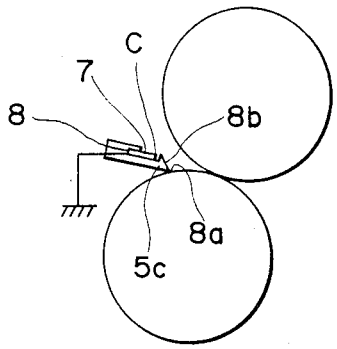
FIG. 6 is a side view of an image fixing device according to a further embodiment of the present invention.

FIG. 6 shows a further embodiment of the present invention, wherein the conductive needles are integrally provided on the top of the separation pawl 8. The separation pawl 8 has sharp ends 8*a* contacted to the pressing roller 2 surface to separate the paper therefrom and a slope 8*b* for guiding the separated plain paper. The conductive needles 7 are so provided on the separation pawl 8 that the ends C thereof are lower than the top of slope 8*b*. When the paper P discharges through the nip, winding about the pressing roller 2, it is separated by the ends 8*a* of the separation pawls 5C and guided by the slope 8*b* while it is being discharged. Since the ends C of the conductive needles 7 are lower than the top of the guide 8*b*, the paper does not jam when abutting to the conductive needles. Because of this arrangement, the ends C of the conductive needles 7 can be placed above the tip end 8*a* of the separation pawl 5C. Therefore, the ends 8*a* can be further approached to the nip between the rollers 1 and 2. In other words, the ends C of the conductive needles 7 can be placed at any desired position, particularly, adjacent to the exit side end of the nip.

Figure 7:
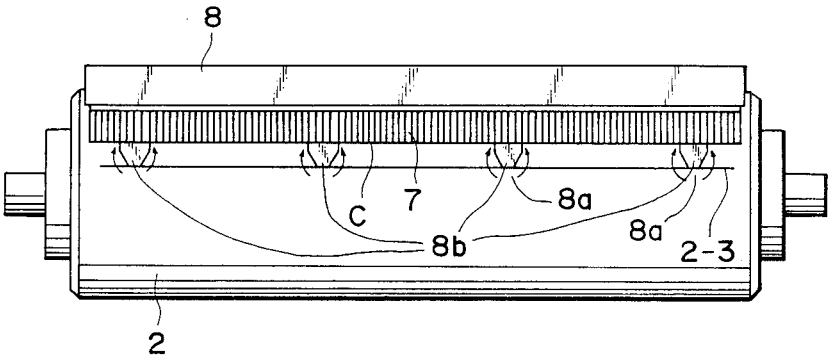
FIG. 7 is a top plan view of the pressing roller used with the embodiment shown in FIG. 6.

The charge removal effect is enhanced by making insulative at least one of the separation pawls 5C and the supporting member 8 which is integral therewith. Although the ends C of the conductive needles 7 are partly hidden by the end portions of the separation pawl 5C, the needles 7 at the both longitudinal sides of the end portions of the separation pawl 5C (FIG. 7), are effective to remove the charge from those parts of the pressing roller 2 which are contacted by the ends of the separation pawl 5C, so that the charge removal is uniform over substantially the entire length of the pressing roller 2. FIG. 7 is a plan view of the pressing roller 2 of FIG. 6.

As described above, by providing an integral separation pawl and charge removing needles, the charge removing member can be placed at desired positions to make the charge removal operation stable.

Figure 8:
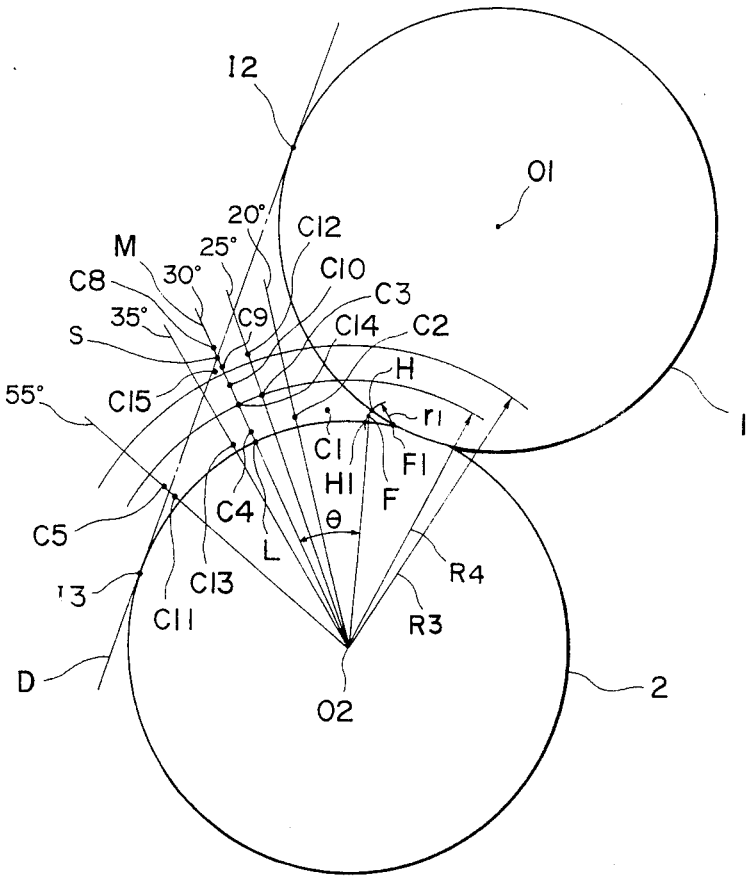
FIG. 8 is an illustration for the regions defined by the present invention.

FIG. 8 is an illustration of the region where the ends C of the conductive needle 7 are to be placed.

It has been described hereinbefore that the ends C are located "adjacent" the nip formed between the first (pressing) roller 2 and second (heating) roller 1. The term "adjacent the nip" is intended to mean the region defined by a common tangent line D (actually, it is a "plane", but will be explained as "line" for the sake of simplicity of explanation as seen in the cross-sectional view of FIG. 8) which is tangent both of the peripheral surfaces of the first and second rotatable means at the paper exit side; and by the peripheral of the first and second rollers. More particularly, it is the region formed by the end F1 of the nip when there is no paper and the tangent points I2 and I3 between the common tangent line D and the first and second rollers, that is the region enclosed by the lines $\overline{I2, I3}$, $\overset{\frown}{I3, F1}$, $\overset{\frown}{F1, F2}$, as shown in FIG. 8. The above described advantageous effects can be obtained by using the charge removing members having charge removing ends positioned within the region "adjacent the nip" as defined above.

The nip itself in the "adjacent region" can vary because of the existence of the recording medium placed in the nip upon the fixing operation. More particularly, the paper exit side end F1 (when no paper exists) of the nip extends toward the exit side when the paper is in the nip (the end of the nip in this condition is depicted by reference character F) by a few or several mm, and after the paper has passed through the nip, its end restores the original position F1. The triboelectric charge of the rotatable members 1 and 2 and the recording material, i.e., the paper P is produced at the nip. The separation charge, produced when the first roller 2 and the second roller 1 separate, particularly when the first roller 2 and the paper P separate, is the major cause of the offset. To avoid the influence by the separation charge, the charge removing member is located within the separation region. The "separation region" is defined as the region which is near the end F and which is near the substantially middle point between the point H on the second roller 1 surface which is spaced apart from the point F1 by the distance r1 (2 mm–3 mm in this embodiment) and the point H1 on the first roller 2 surface which is spaced apart from the point F1 by the same distance, on the assumption that the distance between the points F and F1 is a few mm. That is, the separation region is such that the charge removing ends located in the region can view the portion (near the end F) where the separation charging takes place.

Further, in the region "adjacent the nip", there is a particular region which is met by the positions C1, C2, C3 and C4, and where the charge removing effect is particularly high and the reduction of the offset is at a higher rank. It has been found that this particular region is defined by the line connecting the center of the first roller 2 (first rotatable member) and the nip F1 without the paper (preferably F with the paper) and by the line M passing through the same center and angularly spaced therefrom by 30°. The intersection between the line M and the common tangent line D is depicted by point S, and the intersection between the line M and the outer surface of the first roller 2 is depicted by point L. The above mentioned further preferable region is defined by $\widehat{F,H1}$, $\overline{I2,S}$, $\overline{S,L}$, $\widehat{L,H1,F}$, which is called a "proximity region".

Within this region, the charge removing ends are further preferably located near that one of the rollers which is more easily charged. In the foregoing embodiment, the first roller or the pressing roller is explained as such one of the rollers, which is contacted by the back face of the recording member, the front face having the image to be fixed.

The effects of the charge removing members in these regions will be described in the same manner as with FIG. 1 embodiment in conjunction with FIG. 2, but using the following Table, i.e., Table 2.

TABLE 2

| Positions of Charge Removing Ends C, Distance d (mm) and Angle θ (degree) | | | | Offset Toner (%) | Surface Potential of Pressing Roller (V) | Group |
|---|---|---|---|---|---|---|
| Comparative Example | C8 | 15 | 30 | 0.58 | −6000 (X) | For Reference |
| Present Invention | C9 | 11 | 30 | 0.25 | −1850 | III |
| Present Invention | C10 | 9 | 30 | 0.17 | −1550 | I, III |
| Present Invention | C11 | 1.5 | 55 | 0.29 | −1900 | I, II |
| Present Invention | C12 | 11 | 25 | 0.23 | −1750 | III |
| Present Invention | C13 | 1.5 | 35 | 0.29 | −1900 | I, II |
| Present Invention | C14 | 6 | 30 | 0.16 | −1500 | I, II, III |
| Present Invention | C15 | 11 | 31 | 0.29 | −1900 | |
| Present Invention | C1 | 1.5 | 12 | 0.10 | −550 | I, II, III |
| Present Invention | C2 | 1.5 | 20 | 0.12 | −750 | I, II, III |
| Present Invention | C3 | 6 | 25 | 0.16 | −1500 | I, II, III |
| Present Invention | C4 | 1.5 | 30 | 0.14 | −1400 | I, II, III |
| Comparative Example | C5 | 4 | 55 | 0.35 | −2700 | For Reference |

The positions of the charge removing ends are categolized into the following three groups:

GROUP I is within the region "adjacent the nip" as defined above and the distance from the surface from which the charge is to be removed (the pressing roller in these embodiments) is not more than 10 mm:

GROUP II is within the same region but the distance defined above is not more than 6 mm: and GROUP III is within the proximity region as defined above.

A position satisfying or belonging to a plurality of these GROUPS, is indicated in Table 2 by naming such plural GROUPS.

Since the pressing roller 2 has an easily chargeable insulative coating layer ($10^8\Omega$ cm or more) in these embodiments, the surface potential thereof is given in the Table to show the effect of the charge removal. The results are shown in the Table for the positions C1–C5, and C8–C14.

First, the explanation will be made with respect to the difference between the region "adjacent the nip" of the present invention and the region outside of the same. The positions C5 and C11 are on the line of 55° as from the line FO2, and the position C5 is little outside of the "adjacent region", while the position C11 is within the "adjacent" region. Both of the regions C5 and C11 are near the common tangent line D. With the charge removing ends located at the position C5, as described hereinbefore, the offset toner was 0.35%, and the surface potential of the pressing roller was −2700 V so that, with the use, the temporal offset toner increase took place rapidly and the toner image was disturbed. With the position C11 which is within the region of the present invention, the offset toner was reduced to not more than 0.3%, i.e., 0.29%, and the surface potential of the pressing roller 2 was reduced to not more than 2000 V, i.e., 1900 V. With these values, the offset toner did not rapidly increase, even if the device was operated continuously. Also, the offset toner could be removed by a usual cleaning means. Additionally, the rapid increase of the pressing roller 2 surface potential could be prevented so that the disturbance to the toner image could be avoided.

Thus, there are remarkable differences between the positions C5 and C11. The position C11 is much better.

Next, the position C8 (outside the common tangent line D) and the position C9 (within the "adjacent region") will be compared. With the position C8 which is 15 mm distant from the pressing roller 2 surface and which is outside the region of the present invention, the surface of the pressing roller 2 could hardly be discharged, and the offset toner was almost 0.6%, more particularly, 0.58%. The amount of the offset toner was so large that it could not be removed by cleaning means and that the toner image was disturbed very much. At the position C9, the offset toner could be reduced to be 0.25%, and the pressing roller 2 surface potential could be reduced to be −1850 V. Those results are even better than the position C11. If the results of the positions C9 and C11 are compared, it is understood that the proximity region (GROUP III) is better, particularly in the amount of the offset toner.

The comparison will now be made between the position C12 belonging to GROUP III, i.e., the proximity region and the position C16 which does not belong to GROUP III but which is within the region of the present invention. Positions C1–C4, C9, C10 and C14 are similar to the position C12, while positions C11 and C13 are similar to the position C16. The positions C12 and C16 to be compared are the same in the other conditions to make the comparison clear. The position C12 which is within the proximity region, provides a further higher charge removing effect and higher offset prevention effect. Because of the proximity to the nip, the charging by the friction or the separation can be efficiently prevented, and further the disturbance to the image can be prevented.

Next, the description will be made on the effect of the distance from the surface from which the charge is to be removed, referring to GROUPS I and II.

Considering the data of the various positions, it is understood that the charge removing effect and the offset prevention effect are increased with the decrease of the distance. The effects are very much improved by belonging to GROUP I, and inter alia to GROUP II. This will be understood, looking at the data of positions C9, C10, C14 and C4 (on the line of 30° and under the same conditions), also the data of positions C12 and C3 (on the line of 25°).

The position C9 which was within the region of the present invention, but which was outside GROUP I and GROUP II, reduced the offset toner to 0.25% and the pressing roller 2 surface potential −1850 V. The position C10 belonging to GROUP I provided the reduction of the offset toner to 0.17% and the reduction of the pressing roller 2 surface potential to −1550 V. Those remarkable effects are believed to be provided by the easier concentration, of the electric field formed to the pressing roller 2 surface, onto the ends of the needle, which increases the charge removing efficiency.

Furthermore, the positions C14 and C4 could reduce the offset toner to not more than 0.16% and the pressing roller 2 surface potential to −1500 V, thus showing a further prevention of the image disturbance. The resultant image was so free from the disturbance that a grandchild copy, which was a copy of a copy of an original, had hardly any recognizable disturbance. With these positions C4 and C14, which is not more than 4 mm spaced apart from the pressing roller 2, it is believed that the charge removing end has a larger range from which it can instantaneously remove the charge, and that the magnitude of the concentrated field is increased, so that the above advantageous effects can be provided.

As described above, each region has its own better results. However, the results become better by the combination of the GROUPS. That is, the effects are improved when a position of the charge removing end belongs to plural GROUPS.

More particularly, the effects are improved in the following order:

(1) The ends belonging to GROUP I:
(2) The ends belonging both to GROUP I and GROUP II, or to GROUP III:
(3) The ends belonging both to GROUP I and GROUP III: and
(4) The ends belonging to all of GROUPS I, II and III (this showed the most preferable results).

Of course, any of these are within the region of the region "adjacent the nip".

It is added here that the features of the respective positions apply to the embodiment of FIG. 9 which will be described in the following paragraphs.

Figure 9:
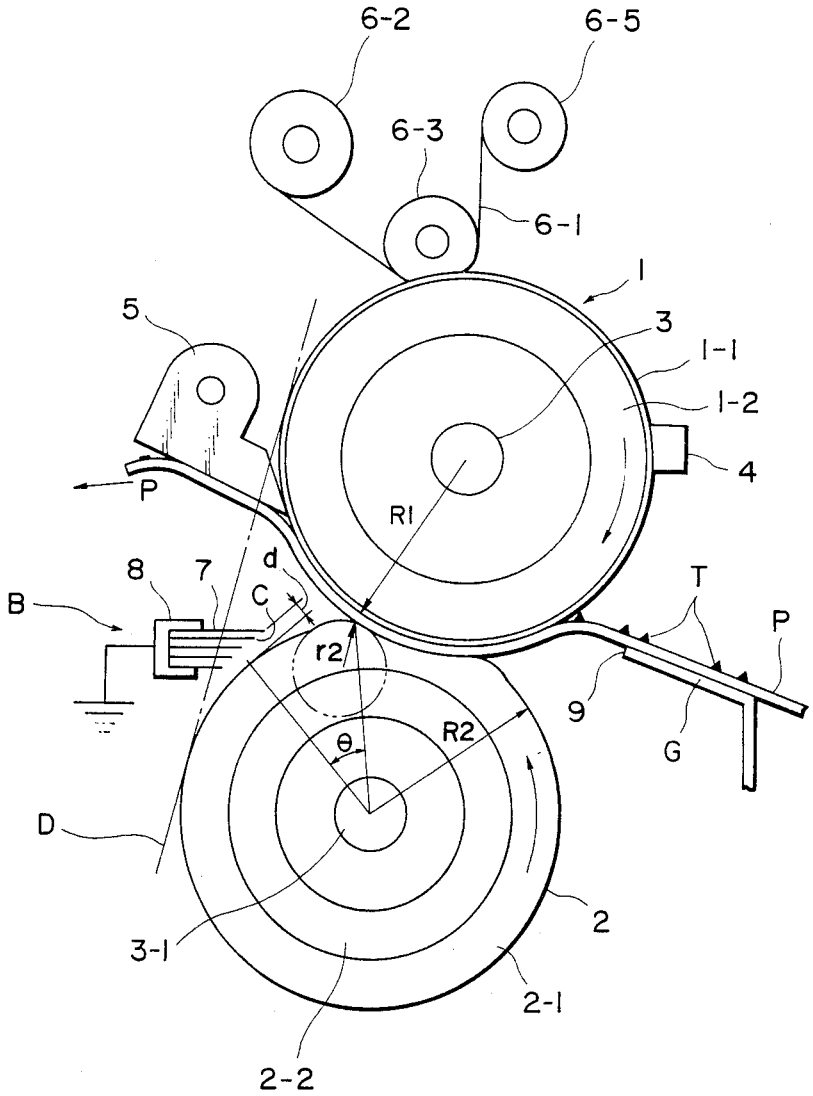
FIG. 9 is a side view of an image fixing device according to yet a further embodiment of the present invention.

FIG. 9 illustrates a further embodiment of the present invention which contains the structures applicable to the foregoing embodiments. The structures of the fixing device of this embodiment is substantially similar to the foregoing embodiments. And, the positions of the charge removing ends of this embodiment are partly the same as those of the foregoing embodiments.

Similarly to the foregoing embodiments, the fixing device of FIG. 9 includes a non-contact type charge removing means having a grounded supporting member 8 and conductive needle-like members 7. The charge removing means is located at the paper exit side of the nip formed by the rollers 1 and 2. As described hereinbefore, the following points are desired for the charge removing means to efficiently function:

(1) The charge removing ends C are located as near as possible to the nip which is the source of the roller surface charging:
(2) All of the charge removing ends C are located as near as possible to the roller surface: and
(3) The electric field is concentrated only on the ends C of the charge removing needles.

In order to satisfy the above point (1) and also point (2) without impeding the passage of the paper, the present embodiment employs the charge removing members having the ends C which are arranged substantially parallel to the roller surface, as shown in FIG. 9, so that all of the needle ends C are made close to the roller surface.

The experiments showed the results that, with the FIG. 9 arrangement, the offset toner was reduced to 0.21% and the pressing roller 2 surface potential was reduced to −1900 V, when the angle $\theta$ of the end C position was 40°, and the distance between the ends C and the roller 2 surface was substantially constant, i.e., d=3 mm. Those results are better than the case where the needle ends C are arranged as shown in FIG. 1, which showed the results that the offset toner was 0.3% and the pressing roller 2 surface potential was −2500 V. Further, in order to meet the above point (3), a charge removing needle comprising a carbon fiber of 5$\mu$ diameter and a coating, thereon, of 7$\mu$ thickness made of epoxy resin was used for making the electric field concentrate on the ends C. This reduced the offset toner to 0.15% and the pressing roller surface potential to −1450 V.

Those values were obtained using the roller structures shown with FIG. 1, wherein the outer diameters 2R1 and 2R2 of the rollers 1 and 2 were 60 mm, and wherein those rollers were press-contacted with each other under the total pressure of 60 kg. The sheet used was A3 size (JIS) and fed at the speed of 23 sheets per min. (roller peripheral speed was 270 mm/sec.). The toner used was negatively charged (negative toner). The amount of the offset toner is represented as the weight ratio (%) of the offset toner to the quantity of the unfixed toner on the paper P. The surface potential of the pressing roller 2 is given also, because it affects the negative timer, so that it is one of the important factors to be compared.

In this embodiment, the ends C of the charge removing needles 7 are arranged in a straight line substantially parallel to the surface of the roller 2. However, the present invention is intended to cover the case where the ends are arranged equidistantly in curvature concentric with the roller 2 surface. The present invention is also effective for the pressure fixing device.

The difference in the effect when the charge removing ends C of this embodiment of the present invention will be described in conjunction with FIGS. 2 and 8.

In this embodiment, the ends C of the charge removing means 8 are located adjacent to the nip.

The effects of the charge removing ends C located at various positions C1–C7 as shown in FIG. 2, are shown in Table 3.

TABLE 3

| Positions of Charge Removing Ends C, Distance d (mm) and Angle $\theta$ (degree) | | | | Offset Toner (%) | Surface Potential of Pressing Roller (V) |
|---|---|---|---|---|---|
| Present Embodiment | C1 | 1.5 | 12 | 0.09 | −450 |
| Present Embodiment | C2 | 1.5 | 20 | 0.11 | −700 |
| Present Embodiment | C3 | 6.0 | 25 | 0.14 | −1400 |
| Present Embodiment | C4 | 1.5 | 30 | 0.13 | −1300 |
| | C5 | 1.5 | 55 | 0.32 | −2500 |
| | C6 | 1.5 | 82 | 0.41 | −2800 |
| | C7 | 1.5 | 138 | 0.45 | −2800 |

TABLE 3-continued

| Positions of Charge Removing Ends C, Distance d (mm) and Angle θ (degree) | Offset Toner (%) | Surface Potential of Pressing Roller (V) |
|---|---|---|
| No charge removing means | 0.60 | −6000 or more |

In Table 3, the angle θ is the angle to the position from the reference line connecting the center of the pressing roller 2 and the paper exit side end F of the nip (preferably the point where the paper and the pressing roller start to separate). The distance between the charge removing end C and the pressing roller 2 surface is given by d.

The surface potential of the heating roller 1 was −100 V to −150 V in those cases.

Comparing Table 3 with the foregoing Tables, the effects of the present invention are further improved by making the charge removing ends substantially parallel to the roller surface to be discharged. That is, the offset prevention effects and the twine prevention effects are increased.

According to the present invention, a stable and long term charge removing effect which could not be provided conventional method, can be provided so that the offset can be prevented. The effects are the ones not provided by a conventional non-contact type method. The offset can be kept less, and the twining can be prevented, for a long period.

In the foregoing embodiment, the negative toner has been used, but positive toner can be used.

The present invention is particularly effective to a heating type fixing means, but also effective to a pressure type fixing means. The present invention is particularly effective to toner images, as the material to be fixed.

The rotatable member used with the present invention has been described as a roller, but is may be a belt. The present invention covers the any combinations of parts of the respective embodiments, and those similar to the combinations.

The charge removing member has been described as a needle-like member having the charge removing ends. It may be a metal fiber, conductive fiber such as a semiconductor (metal oxide), ceramic and a conductive fibers, and a resin which has been treated to be conductive.

While the invention has been described with reference to the structures disclosed herein, it is not confined to the details set forth and this application is intended to cover such modifications or changes as may come within the purpose of the improvements or the scope of the following claims.

What is claimed is:

1. An image fixing device, comprising:

first and second rotatable members for forming a nip therebetween, which transport from an entrance side to an exit side a recording material and fix an image thereon;

means for driving said first and second rollers;

charge removing means having charge removing ends arranged along the longitudinal direction of said rotatable members and adjacent to but spaced from the peripheral surface of said first rotatable member, wherein each charge removing end is positioned within a predetermined exit-side region of a plane transverse to said longitudinal direction, the boundaries of which planar region are defined by the common tangent line which is tangent to the peripheral surface of both rotatable members on the exit side and the peripheral surfaces of said first and second rotatable members from their respective tangent points to the common exit and press-contact area between said rotatable members.

2. A device according to claim 1, wherein the charge removing ends of said charge removing means are spaced apart from the peripheral surface of said first rotatable member, from which electric charge is to be removed, by not more than 10 mm.

3. A device according to claim 1, wherein the charge removing ends of said charge removing means are spaced apart from the peripheral surface of said first rotatable member, from which electric charge is to be removed, by not more than 6 mm.

4. A device according to claim 2, wherein each charge removing end is positioned within the portion of the predetermined exit-side region which is within an arc of 30° from the radius extending from the center of said first rotatable member to the exit side end of the press-contact area.

5. A device according to claim 3, wherein each charge removing end is positioned within the portion of the predetermined exit-side region which is within an arc of 30° from the radius extending from the center of said first rotatable member to the exit side end of the press-contact area.

6. A device according to claim 1, wherein each charge removing end is positioned within the portion of the predetermined exit-side region which is within an arc of 30° from the radius extending from the center of said first rotatable member to the exit side end of the press-contact area.

7. A device according to any one of claims 1–3, 4–6, wherein the charge removing ends of said charge removing members arranged also along the peripheral surface of said first rotatable member and they are substantially equidistant from the peripheral surface of said first rotatable member.

8. A device according to any one of claims 1–3, 4–6, wherein the charge removing means is integral with a member for separating the recording material from the peripheral surface of said first rotatable member.

9. A device according to any one of claims 1–3, 4–6, wherein said charge removing means includes a conductive member having the charge removing ends and an electrically insulating member covering the conductive member except for the charge removing ends.

10. A device according to any one of claims 1–3, 4–6, wherein said charge removing means includes a conductive member having the charge removing ends and a conductive supporting member for supporting said conductive member, said supporting member being grounded.

11. A device according to claim 10, wherein said supporting member is covered with an electrically insulating member.

12. A device according to any one of claims 1–3, 4–6, wherein said first rotatable member includes a insulating layer.

13. A device according to claim 12, wherein said first rotatable member includes a surface layer which is easier to electrically charge than the second rotatable member.

14. A device according to claim 13, wherein said charge removing means includes a conductive member having the charge removing ends and an electrically insulating member covering the conductive member except for the charge removing ends.

15. A device according to claim 14, wherein said charge removing means includes a conductive supporting member for supporting said conductive member having the charge removing ends, said supporting member being coated with an electrically insulating layer.

16. A device according to claim 15, wherein said supporting member is grounded.

17. A device according to claim 16, wherein said rotatable members fix an image formed with toner particles electrically charged to a predetermined polarity.

18. A device according to claim 17, wherein said first rotatable member is a pressing roller adapted to contact a non-image-bearing side of the recording material and having a resilient surface.

19. A device according to claim 7, wherein the charge removing means is integral with a member for separating the recording material from the peripheral surface of said first rotatable member.

20. A device according to claim 7, wherein said charge removing means includes a conductive member having the charge removing ends and an electrically insulating member covering the conductive member except for the charge removing ends.

21. A device acccording to claim 20, wherein said charge removing means includes a conductive member having the charge removing ends and a conductive supporting member for supporting said conductive member, said supporting member being grounded.

22. A device according to claim 21, wherein said supporting member is covered with an electrically insulating member.

23. A device according to claim 22, wherein said first rotatable member includes a insulating layer.

24. A device according to claim 23, wherein said first rotatable member is a pressing roller adapted to contact a non-image-bearing side of the recording material and having a resilient surface.

25. A device according to claim 14, wherein said rotatable members fix an image formed with toner particles electrically charged to a predetermined polarity.

26. A device according to claim 25, wherein the charge removing means is integral with a member for separating the recording material from the peripheral surface of said first rotatable member, and wherein said separating member has a surface coating of an electrically insulating material.

27. A device according to any one of claims 1–6, wherein said rotatable members fix an image formed with toner particles electrically charged to a predetermined polarity.

28. A device according to claim 8, wherein said separating member has an electrically insulating surface.

29. A device according to claim 19, wherein said separating member has an electrically insulating surface.

30. A device according to claim 13, wherein said first rotatable member is a pressing roller adapted to contact a non-image-bearing side of the recording material and having a resilient surface.

31. A device according to claim 30, wherein said rotatable members fix an image formed with toner particles electrically charged to a predetermined polarity.

32. A device according to claim 31, wherein said predetermined polarity is the same as the polarity to which the first rotatable member tends to be charged.

33. A device according to claim 13, wherein said second rotatable member is contactable with an unfixed image on the recording material, and wherein the charge removing ends are adapted to be positioned between the surface of the first rotatable member and the recording material.

34. A device according to claim 1, wherein said charge removing ends are so positioned that they are out of contact with the recording material.

* * * * *

UNITED STATES PATENT AND TRADEMARK OFFICE

CERTIFICATE OF CORRECTION

PATENT NO. : 4,525,058

DATED : June 25, 1985

INVENTOR(S) : HIROMITSU HIRABAYASHI, ET AL.

It is certified that error appears in the above-identified patent and that said Letters Patent is hereby corrected as shown below:

Column 9, lines 50 and 51, "categolized" should read --categorized--.

Column 13,line 37, "is" should read --it--.

Column 14, line 37, Claim 7, "members" should read --means are--;

line 60, Claim 12, "a" should read --an--.

Signed and Sealed this

Tenth Day of June 1986

[SEAL]

*Attest:*

DONALD J. QUIGG

*Attesting Officer*

*Commissioner of Patents and Trademarks*